US012680543B2

(12) United States Patent
Korte et al.

(10) Patent No.: US 12,680,543 B2
(45) Date of Patent: Jul. 14, 2026

(54) PUMP AND METHOD FOR ADJUSTING THE DELIVERY RATE OF A PUMP

(71) Applicant: ITT Bornemann GmbH, Obernkirchen (DE)

(72) Inventors: Eike Steffen Korte, Obernkirchen (DE); David Johannes Blatt, Obernkirchen (DE)

(73) Assignee: ITT Bornemann GmbH, Obernkitchen (DE)

( * ) Notice: Subject to any disclaimer, the term of this patent is extended or adjusted under 35 U.S.C. 154(b) by 0 days.

(21) Appl. No.: 18/924,899

(22) Filed: Oct. 23, 2024

(65) Prior Publication Data

US 2025/0137455 A1 May 1, 2025

(30) Foreign Application Priority Data

Oct. 25, 2023 (DE) ..... 102023129457.1

(51) Int. Cl.
*F04C 14/24* (2006.01)
*F04C 15/06* (2006.01)
*F04C 2/12* (2006.01)

(52) U.S. Cl.
CPC ..... *F04C 14/24* (2013.01); *F04C 15/06* (2013.01); *F04C 2/126* (2013.01)

(58) Field of Classification Search
CPC ..... F04C 14/24; F04C 15/06; F04C 2/126
See application file for complete search history.

(56) References Cited

U.S. PATENT DOCUMENTS

| | | | | |
|---|---|---|---|---|
| 1,677,980 | A | 7/1928 | Josef | |
| 2,757,897 | A * | 8/1956 | Cline | F16K 41/043 251/266 |
| 3,932,073 | A | 1/1976 | Schibbye et al. | |
| 4,017,223 | A | 4/1977 | Blackwell | |
| 4,212,543 | A | 7/1980 | Bersano | |
| 4,744,669 | A | 5/1988 | Kowalczyk et al. | |
| 4,824,348 | A | 4/1989 | Winyard | |
| 5,018,952 | A | 5/1991 | Winyard | |
| 5,083,506 | A | 1/1992 | Horn et al. | |
| 5,372,418 | A | 12/1994 | Biesenberger et al. | |
| 6,186,655 | B1 | 2/2001 | Brookes et al. | |
| 6,298,751 | B1 | 10/2001 | Ide et al. | |
| 6,685,453 | B2 | 2/2004 | Oehman, Jr. et al. | |
| 7,017,732 | B2 | 3/2006 | Uphus | |

(Continued)

FOREIGN PATENT DOCUMENTS

| | | | |
|---|---|---|---|
| AT | 342 423 | B | 4/1978 |
| CN | 108180140 | A | 6/2018 |

(Continued)

*Primary Examiner* — Shafiq Mian
(74) *Attorney, Agent, or Firm* — VIA LLP

(57) ABSTRACT

A pump for conveying a medium having a suction-side inlet, a pressure-side outlet, a suction chamber, and a conveyance housing. The conveyance housing having a pressure chamber and a transport element. The transport element rotatably supported in the conveyance housing for conveying the medium from the suction chamber into the pressure chamber. The pump having a recirculation line via which the medium is supplied from the pressure chamber to the suction chamber, wherein an exchangeable insert having an unchanging flow area is arranged in the recirculation line.

12 Claims, 5 Drawing Sheets

(56) References Cited

U.S. PATENT DOCUMENTS

| | | | | |
|---|---|---|---|---|
| 7,862,315 | B2 | 1/2011 | Rohlfing et al. | |
| 8,764,424 | B2 | 7/2014 | Kirkland | |
| 9,630,345 | B2 | 4/2017 | Alsewailem | |
| 10,486,383 | B1 | 11/2019 | Allard et al. | |
| 10,731,082 | B2 | 8/2020 | Tenore et al. | |
| 11,241,026 | B2 | 2/2022 | Wenger et al. | |
| 2005/0219943 | A1 | 10/2005 | Yamane et al. | |
| 2007/0274842 | A1 | 11/2007 | Campen et al. | |
| 2011/0158841 | A1 | 6/2011 | Liu et al. | |
| 2013/0156545 | A1 | 6/2013 | Britsch | |
| 2017/0254328 | A1* | 9/2017 | Rohlfing ..... | B01D 45/08 |
| 2021/0355938 | A1 | 11/2021 | Trossmann et al. | |

FOREIGN PATENT DOCUMENTS

| | | | |
|---|---|---|---|
| CN | 111686493 | A | 9/2020 |
| DE | 35 20 994 | A1 | 1/1986 |
| DE | 4416077 | A1 | 11/1995 |
| DE | 19502173 | A1 | 8/1996 |
| DE | 19820523 | A1 | 11/1999 |
| DE | 19829195 | A1 | 1/2000 |
| DE | 10162 772 | A1 | 7/2003 |
| DE | 10251508 | A1 | 5/2004 |
| DE | 10257859 | A1 | 7/2004 |
| DE | 202004018377 | U1 | 4/2005 |
| DE | 102004030123 | B3 | 10/2005 |
| DE | 20 2009 000 690 | U1 | 4/2009 |
| DE | 10 2007 060174 | A1 | 6/2009 |
| DE | 10 2010 038 863 | A1 | 2/2012 |
| DE | 20 2013 000 913 | U1 | 5/2014 |
| DE | 102016120579 | B3 | 4/2018 |
| DE | 102018130472 | A1 | 6/2020 |
| DE | 102021101111 | A1 | 7/2022 |
| DE | 102021208481 | A1 | 2/2023 |
| EP | 3913187 | A1 | 11/2021 |
| WO | WO 2014/019687 | A2 | 2/2014 |

* cited by examiner

PUMP AND METHOD FOR ADJUSTING THE DELIVERY RATE OF A PUMP

CROSS REFERENCE TO RELATED APPLICATION

Any and all applications for which a foreign or domestic priority claim is identified in the Application Data Sheet of the present application are hereby incorporated by reference in their entireties under 37 CFR 1.57. This application claims the priority benefit of German Application No. 10 2023 129 457.1 filed Oct. 25, 2023, the entirety of which is incorporated herein by reference.

BACKGROUND

Technical Field

The present application relates to a pump for conveying a medium with a recirculation line. The recirculation line conveys the medium from a pressure chamber of the pump to the suction chamber of the pump. The application further relates to a method for adjusting the delivery rate of such a pump.

Brief Description of Related Art

Pumps are used across various industries to transport mediums with differing viscosities and compositions. However, pumps often face issues achieving desired delivery rates.

SUMMARY

In some aspects, the techniques described herein relate to a pump for conveying a medium including: a suction-side inlet; a pressure-side outlet; a suction chamber; a conveyance housing including a pressure chamber; a transport element rotatably supported in the conveyance housing, wherein the transport element is configured to convey a medium from the suction chamber into the pressure chamber; a recirculation line configured to supply the medium from the pressure chamber to the suction chamber; and an exchangeable insert including a fixed flow area positioned in the recirculation line.

In some aspects, the techniques described herein relate to a pump, wherein the exchangeable insert includes a bolt configured to be screwed in, clamped in, or inserted.

In some aspects, the techniques described herein relate to a pump, wherein the exchangeable insert is positioned in an opening of the conveyance housing or a socket positioned in the opening of the conveyance housing.

In some aspects, the techniques described herein relate to a pump, wherein the socket corresponds to the opening and the insert corresponds to the socket.

In some aspects, the techniques described herein relate to a pump, wherein the socket penetrates the suction chamber.

In some aspects, the techniques described herein relate to a pump, wherein the insert corresponds to the opening.

In some aspects, the techniques described herein relate to a pump, wherein the insert includes a longitudinal bore and a transverse bore that are fluidly connected to one another, wherein the medium travels from the pressure chamber into the insert via the longitudinal bore and out of the insert into the suction chamber via the transverse bore. 8.

In some aspects, the techniques described herein relate to a pump, wherein the fixed flow area of the insert is the smallest flow area of the recirculation line.

In some aspects, the techniques described herein relate to a pump, wherein the insert includes a scaling element, wherein the sealing element is an O-ring or a sealing tape.

In some aspects, the techniques described herein relate to a method for adjusting the delivery rate of a pump for conveying a medium, the method including: determining the effective delivery rate of a pump at a predefined speed of the transport element; determining the deviation of the effective delivery rate of the pump at the predefined speed of the transport element compared to a target delivery rate at the predefined speed of the transport element; and inserting an insert having a fixed flow area into the recirculation line, wherein the fixed flow area of the insert has dimensions such that the effective delivery rate of the pump at the predefined speed of the transport element corresponds to the target delivery rate at the predefined speed of the transport element.

In some aspects, the techniques described herein relate to a method, wherein the pump includes: a suction-side inlet; a pressure-side outlet; a suction chamber; a conveyance housing including a pressure chamber; a transport element rotatably supported in the conveyance housing configured to convey the medium from the suction chamber into the pressure chamber; and a recirculation line configured to transport the medium from the pressure chamber to the suction chamber.

In some aspects, the techniques described herein relate to a method, wherein the determination of the effective delivery rate of the pump is carried out at at least one of a defined viscosity of the medium or a defined differential pressure.

BRIEF DESCRIPTION OF THE DRAWINGS

The drawings include the following Figures, which are not necessarily drawn to scale.

Figure 1:
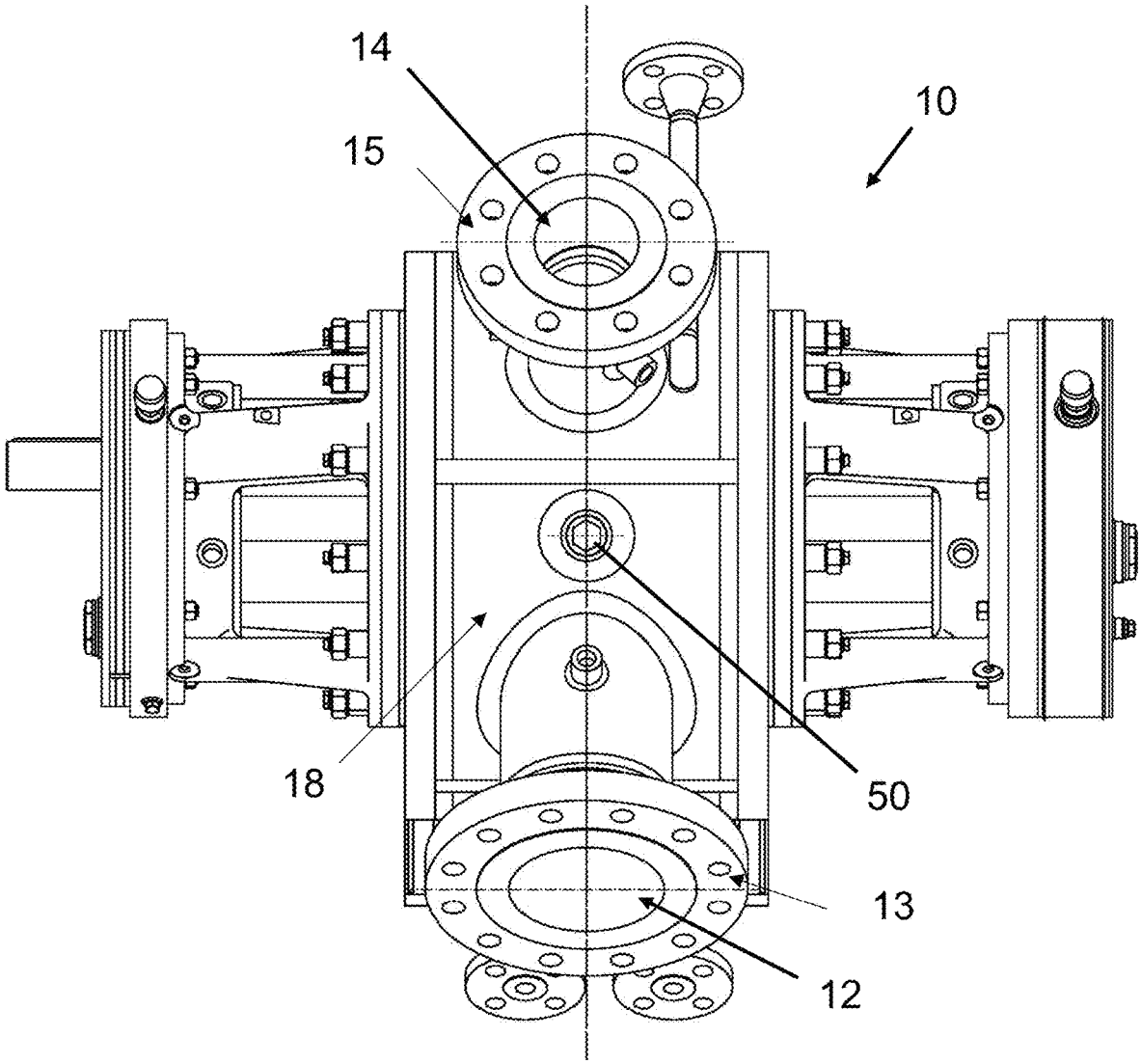
FIG. 1 illustrates a perspective top view of a pump, according to some embodiments.

The drawing includes examples of possible implementations; and the scope of the invention is not intended to be limited to the implementations shown therein. For example, the scope of the invention is intended to include, and embodiments are envisioned using, other implementations besides, or in addition to, that shown in the drawing, which may be configured within the spirit of the underlying invention disclosed in the present application as a whole.

DETAILED DESCRIPTION

The present application relates to a pump for conveying a medium. The pump may include a suction-side inlet, a pressure-side outlet, a suction chamber, and a conveyance housing. In some embodiments, the conveyance housing includes a pressure chamber. The pump may also include a transport element that is rotatably supported in the conveyance housing for conveying the medium from the suction chamber into the pressure chamber. The pump may further include a recirculation line via which the medium is supplied from the pressure chamber to the suction chamber. In some embodiments, an exchangeable insert having a fixed flow area is arranged in the recirculation line. The present application further relates to a method for adjusting the delivery rate of such a pump.

Pumps are known in the prior art. However, in many applications, the delivery rate of a pump must be very precise, for example, in order to allow for accurate metering of the medium or to ensure that the production process functions properly and that quality problems do not arise. The effective delivery rate of pumps depends on various parameters, in particular the speed, viscosity of the medium, differential pressure, clearance, and number of chambers.

Regarding the clearance, due to inevitable manufacturing tolerances, the structurally provided clearances and thus also the structurally provided delivery rate are not precisely achieved at a predefined speed of the transport element. The actual delivery rate is therefore inevitably associated with tolerances.

The adjustment of the delivery rate is a difficult and complex task due to the varied influencing parameters, in particular when no further process changes, i.e., changes in the speed of the transport element or the transport elements, are to be carried out during operation. In this case, the pump must first be mounted, set up for trial operation, measured, and then disassembled if necessary. Other transport elements must be inserted, or the existing transport elements must be remanufactured or retooled. For the users, these tasks can only be managed with difficulty, if at all. Retooling requires a great deal of time and is associated with high costs.

WO 2014/019687 A2, which is incorporated by referenced herein, discloses a multi-phase pump having a recirculation line for returning the liquid phase for lubrication.

One problem addressed by the present disclosure is to provide a pump as well as a method that allows the effective delivery rate of the pump to be set in a cost-effective, fast, and precise manner at a predefined speed of the transport element. According to the present disclosure, precise effective delivery rates can be achieved by a pump having the features of the present disclosure. Advantageous embodiments and further developments of the pump are disclosed in the claims, sub-claims, the description, and the figures.

According to certain embodiments, a pump for conveying a medium is disclosed, having a suction-side inlet, a pressure-side outlet, a suction chamber, a conveyance housing having a pressure chamber, and a transport element rotatably supported in the conveyance housing for conveying the medium from the suction chamber into the pressure chamber, and having a recirculation line via which the medium is supplied from the pressure chamber to the suction chamber. An exchangeable insert having an unchanging flow area can be arranged in the recirculation line.

One advantage of the pump in the present disclosure is that the delivery rate of the pump can be quickly and precisely adjusted by adding an insert having a fixed flow area while the transport element maintains a fixed speed. Due to the fixed flow area, at the fixed speed of the transport element, a substantially constant dead-volume flow is continuously produced in the recirculation line. In some embodiments, the size of the fixed flow area of the insert corresponds to an effective delivery rate at the predefined speed of the transport element.

In some instances, pumps are used at an operating range within which the pump provides the desired delivery rate or delivery rate range at certain operating parameters. For example, an inspection or quality check may be carried out at a guarantee point, in which the primary or expected operating parameters are present. During the inspection, the pump must demonstrate the desired delivery rate at a predefined speed of the transport element. When the predefined speed is reached, the actual delivery rate at the outlet is measured. This measurement is usually carried out with an insert having a minimum flow area. For example, a flow area with a diameter of zero or a closed recirculation line. In some instances, the actual delivery rate is above the desired delivery rate at the guarantee point.

The necessary flow area for the insert is calculated from the difference between the actual delivery rate and the target delivery rate. The appropriate insert may be selected or manufactured and then deployed. A re-inspection by operating the pump at the predefined speed at the guarantee point shows whether the desired delivery rate has been achieved or whether further changes must be carried out by way of another insert. A system consisting of multiple inserts having different flow areas facilitates the adjustment of the delivery rate. By installing a suitable insert having the defined flow area, the effective delivery rate at the predefined speed of the transport element can thus be corrected to correspond to a desired delivery rate at the predefined speed of the transport element. In some embodiments, no disassembly of the pump is required to adjust the delivery rate at the predefined speed of the transport element.

If a different effective delivery rate is to be achieved at the predefined speed of the transport element, the insert can be exchanged for an insert having a different fixed flow area. In some embodiments, an insert may be adjusted accordingly (e.g., the fixed flow area may be increased or decreased). In some embodiments, the fixed flow area of the exchangeable insert cannot be changed during the operation of the pump when the insert is arranged in the recirculation line. If an insert having a larger flow area is employed, this results in a lower effective delivery rate at the predefined speed of the transport element. However, a smaller flow area of the insert results in a greater effective delivery rate at a constant speed.

In some embodiments, a predefined, unchanging flow area of the exchangeable insert is unchanging. For example, in such embodiments, the flow area cannot be changed during operation of the pump when the insert is arranged in the recirculation line. According to certain embodiments, the suction chamber is fluidly arranged between the inlet and the transport element. The transport element may be a helical screw, a rotary piston, a worm, or a gear. The flow area is predefined or fixed in that it is determined by selecting the correct or necessary insert having the appropriate flow area based on measured values prior to operating the pump. In some embodiments, the insert may be easily exchanged for inserts with different fixed flow areas. Thus, the if the effective delivery rate changes due to changed operating conditions or wear, adjustments to the fixed flow area may be made by exchanging the insert. The exchangeable insert may be configured as a bolt that can be screwed in, clamped in, or inserted. Thus, the exchangeable insert may be simple to replace and install (e.g., insert into the recirculation line).

In some embodiments, the insert is inserted into an opening of the conveyance housing or into a socket that has been inserted into the opening of the conveyance housing. Advantageously, a corresponding system having an insert and a socket can be easily retrofitted in existing pumps. The adjustment of the inserts to the characteristics of the socket can be carried out separately so that the respective inserts can be optimally aligned with the socket. The socket is supplied together with a set of inserts having different flow diameters and can also be used as a module in the context of a retrofit.

In some embodiments, the socket is fixed in the conveyance housing by pressing, screwing, or welding. A stable connection may be established between the socket and the conveyance housing. Alternatively, the socket is produced integrally with the conveyance housing. This ensures that the socket cannot become disengaged over time.

The socket may be configured to correspond to the opening in the conveyance housing, and the insert may be configured to correspond to the socket. For example, the socket may have a contour, in particular an inner diameter, that corresponds to the contour of the insert, in particular an outer diameter of the insert. Thus, tolerances between the opening of the conveyance housing and the socket and between the socket and the insert may be minimized, so that leakages are effectively reduced or removed. Alternatively or in addition, the insert is configured to correspond to the opening.

In some embodiments, the pump comprises a housing on which the inlet and the outlet are arranged. The conveyance housing may be arranged in the housing. Positioning the conveyance housing in the housing may optimize the flow of the medium in the pump and may dampen vibrations and sounds so that the noise emissions of the pump are reduced. Alternatively, the inlet and the outlet may be arranged on the conveyance housing. Positioning the inlet and outlet on the conveyance housing may advantageously reduce the size and complexity of the pump.

Advantageously, the socket may penetrate the suction chamber to enables a simple and cost-efficient embodiment of the recirculation line. In some embodiments, the suction chamber at least partially surrounds the conveyance housing.

In some embodiments, the insert comprises a longitudinal bore and a transverse bore, which are fluidly connected to one another, wherein the medium travels from the pressure chamber via the longitudinal bore into the insert and via the transverse bore out of the insert and reaches the suction chamber. The longitudinal bore of the insert may be a blind hole that advantageously removes the need to seal the end of the longitudinal bore facing away from the pressure chamber with a sealing element. In addition, the flow behavior of the medium in the recirculation line is optimized by this embodiment, for example, by removing any unwanted dead-volume flow or turbulence.

The socket may have a longitudinal bore that is fluidly connected to the longitudinal bore of the insert and a transverse bore that is fluidly connected to the transverse bore of the insert. This is particularly advantageous in rheological terms (e.g., optimizing flow of the medium while reducing stress, turbulence, and/or unwanted dead-volume flow). In some embodiments, the longitudinal bore of the socket is arranged substantially coaxially to the longitudinal bore of the insert. The transverse bore of the socket may be arranged substantially coaxially to the transverse bore of the insert. This optimizes the flow behavior of the medium within the insert and the socket.

In some embodiments, the longitudinal bore of the socket has a larger diameter than the longitudinal bore of the insert. The transverse bore of the socket may have a larger diameter than the longitudinal bore of the insert. This focuses the pressure gradient in the recirculation line on the insert so that the socket is unloaded, and flow problems within the recirculation line are reduced or removed. In some embodiments, the predefined, fixed flow area of the insert is the smallest flow area of the recirculation line. In this embodiment, the recirculation flow is most influenced by the fixed flow area of the insert. The fixed flow area may be formed in the longitudinal bore of the insert which provides fluid-dynamically advantageous embodiment of the recirculation line (e.g., reduced turbulence, unwanted dead-volume flow, and sheer stress). is thus achieved.

A sealing element may be arranged on the insert. In some embodiments, the scaling element is one or more O-rings, sealing washers, or sealing tapes. The sealing element may advantageously reduce or prevent leakages from the pressure chamber to the suction chamber. In some embodiments, at least one sealing element is arranged on the outer diameter of the bolt. Additionally, or alternatively, at least one sealing element may be arranged between a head of the bolt and the socket and/or an outer thread of the bolt and an inner thread of the socket. With such a sealing element, leakages along the outer diameter of the bolt are avoided.

In some embodiments, the pump comprises at least two transport elements. For example, two mandrel screw spindles can be rotatably mounted in the conveyance housing as a mandrel screw spindle pair or a plurality of mandrel screw spindle pairs. By providing at least two transport elements, the delivery rate of the pump is increased. Additionally, the multiple transport elements can help increase the accuracy and precision of the delivery rate of the pump. The pump may be a single-spindle or multi-spindle mandrel spindle screw pump. Mandrel spindle screw pumps have a high efficiency and a high resistance. The pump may be configured to be single-fluted or multi-fluted.

Furthermore, the present disclosure relates to a method for adjusting the delivery rate of a pump for conveying a medium. As described above, the pump may include a suction-side inlet, a pressure-side outlet, a suction chamber, a conveyance housing having a pressure chamber, and a transport element that is rotatably supported in the conveyance housing for conveying the medium from the suction chamber into the pressure chamber, and having a recirculation line via which the medium is supplied from the pressure chamber to the suction chamber. The method includes the following steps:

a) determining the effective delivery rate of the pump at a predefined speed of the transport element,
b) determining the deviation of the effective delivery rate of the pump at the predefined speed of the transport element compared to a target delivery rate at the predefined speed of the transport element, and
c) inserting an insert having a fixed flow area into the recirculation line, wherein the predefined, fixed flow area of the insert has dimensions so that the effective delivery rate of the pump at a predefined speed of the transport element corresponds to the target delivery rate at the predefined speed of the transport element.

This method advantageously allows the delivery rate of the pump to be adjusted quickly and precisely without the need for disassembly of the pump. In some embodiments, during the determination of the effective delivery rate of the pump, there is a guarantee point at which the delivery rate is typically determined, in particular measured, for a defined viscosity of the medium and/or for a defined differential pressure, in addition to the predefined speed. Based on the difference between the effective, i.e., measured, delivery rate and the target delivery rate at the defined conditions at the guarantee point, the insert with the appropriate flow area is then selected and deployed (e.g., installed in the recirculation line).

In some embodiments, the effective delivery rate is the actual quantity of medium that the pump conveys per unit of time, taking into account losses, in particular losses due to the recirculation of medium via any existing recirculation lines. Further possible losses can be due to friction losses, leakages, wear, temperatures, pressures, or suction conditions. The determination of the effective delivery rate of the pump at the predefined speed of the transport element is accomplished, for example, by measuring and/or calculating.

Preferably, the recirculation line is closed at the predefined speed of the transport element when determining the effective delivery rate of the pump. An insert with a flow area of zero may be configured and installed into the recirculation line to close the recirculation line. In some embodiments, the method can be implemented very inexpensively, because it is not necessary to first provide an output insert having an output flow area.

Alternatively, when determining the effective delivery rate of the pump at the predefined speed of the transport element, an insert having an flow area is arranged in the recirculation line. In some embodiments, after determining the deviation of the effective delivery rate of the pump at the predefined speed of the transport element compared to the target delivery rate at the predefined speed of the transport element, the predefined, fixed flow area of the insert is determined as a function of the deviation of the effective delivery rate of the pump at the predefined speed of the transport element compared to the target delivery rate at the predefined speed of the transport element as well as the output flow area of the output insert. In this way, an iterative adjustment of the flow area can be made.

FIG. 1 shows a top perspective view of one embodiment of a pump 10, which is configured as a mandrel screw spindle, for conveying a medium. The pump 10 comprises a housing 18 having an outer wall on which an inlet 12 having an inlet port 13 and an outlet 14 having an outlet port 15 are arranged. In the embodiment shown, the inlet 12 is arranged laterally to the housing 18 and the outlet 14 is arranged on top of it. An insert 50 is inserted into the housing 18 obliquely from above.

Figure 2:
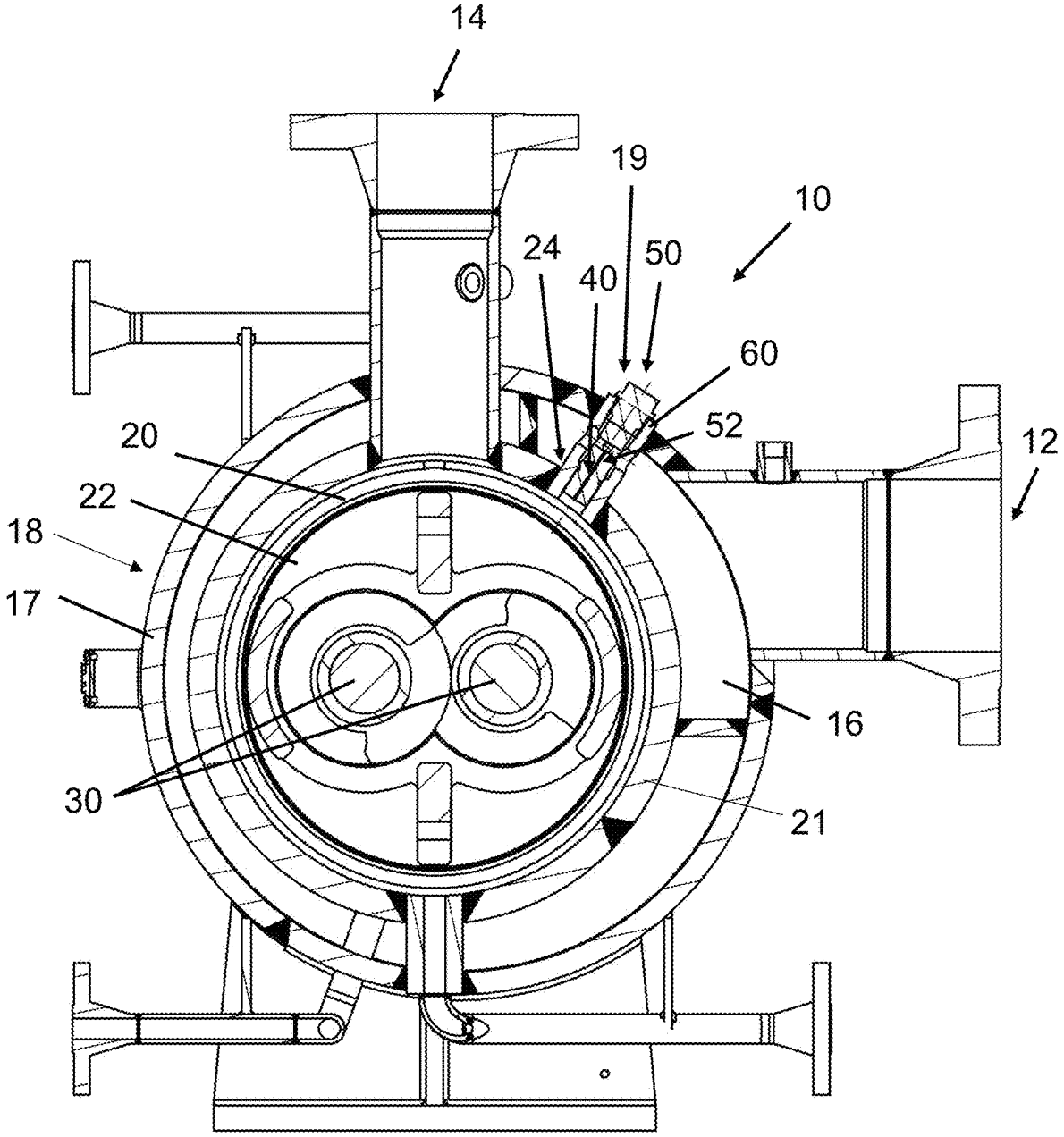
FIG. 2 illustrates a front cross-section view of the pump of FIG. 1, according to some embodiments.

FIG. 2 shows a front cross-sectional view through the pump 10 of FIG. 1. Within the housing 18, two transport elements 30 are arranged in the form of mandrel screw spindles that form a pair of mandrel screw spindles rotatably supported in a conveyance housing 20. In the housing 18, the conveyance housing 20 is arranged within an inner casing 21 or an inner wall and an outer wall 17 of the housing 18. In the illustrated embodiment, the transport elements 30 are configured as double-spindle, double-fluted mandrel screw spindles. In the illustrated embodiment, the direction of flow is from the outside to the center of the transport elements 30.

The medium is conducted through the inlet 12 into the suction chamber 16, which, in the example shown, is formed between the outer wall 17 and the inner casing 21 and surrounds the conveyance housing 20 that encases the transport elements 30. From the suction chamber 16, the medium is conducted perpendicularly to the image plane on both sides into the center of the transport elements 30 and reaches the pressure chamber 22. The transport elements 30 are arranged in a liner, which is inlaid in the conveyance housing 20. From the pressure chamber 22, the medium reaches the outlet 14. In an upper region, the conveyance housing 20 comprises an opening 24 into which a socket 60 is inserted. The socket 60 is also inserted into an opening 19 of the housing 18 that is substantially coaxially arranged in relation to the opening 24 of the conveyance housing 20. The socket 60 can be fixed in the conveyance housing 20 by, for example, pressing, screwing, or welding. Alternatively, it is possible to produce the socket 60 and the conveyance housing 20 integrally. In the example shown, the socket 60 penetrates the housing 18 from the outer wall 17 through the suction chamber 16 and the inner casing 21 into the conveyance housing 20 and forms a recirculation line 40 via which the medium is supplied from the pressure chamber 22 to the suction chamber 16. An exchangeable insert 50 having a predefined, fixed flow area 52 is arranged in the recirculation line 40. In the embodiment shown, the insert 50 is inserted into the socket 60 and closes the outer wall 17. Alternatively, or in addition, the insert 50 may be inserted directly into an opening 24 of the conveyance housing 20. In the embodiment shown, the predefined, fixed flow area 52 of the insert 50 is the smallest flow area of the recirculation line 40.

The effective delivery rate of the pump 10 at a predefined speed of the transport elements 30 is at least partially determined by the predefined, fixed flow area 52, at a defined differential pressure and a defined viscosity of the medium. At a predefined speed of the transport element 30, a continuous, constant dead-volume flow is produced in the recirculation line 40 as a function of the predefined, fixed flow area 52. By inserting an insert 50 having a suitable flow area 52, the effective delivery rate of the pump 10 can thus be adjusted to a desired target value. This allows a simple and precise adjustment of the delivery rate of the pump 10 at a predefined speed of the transport elements 30, without the need for disassembly of the pump 10.

Figure 3:
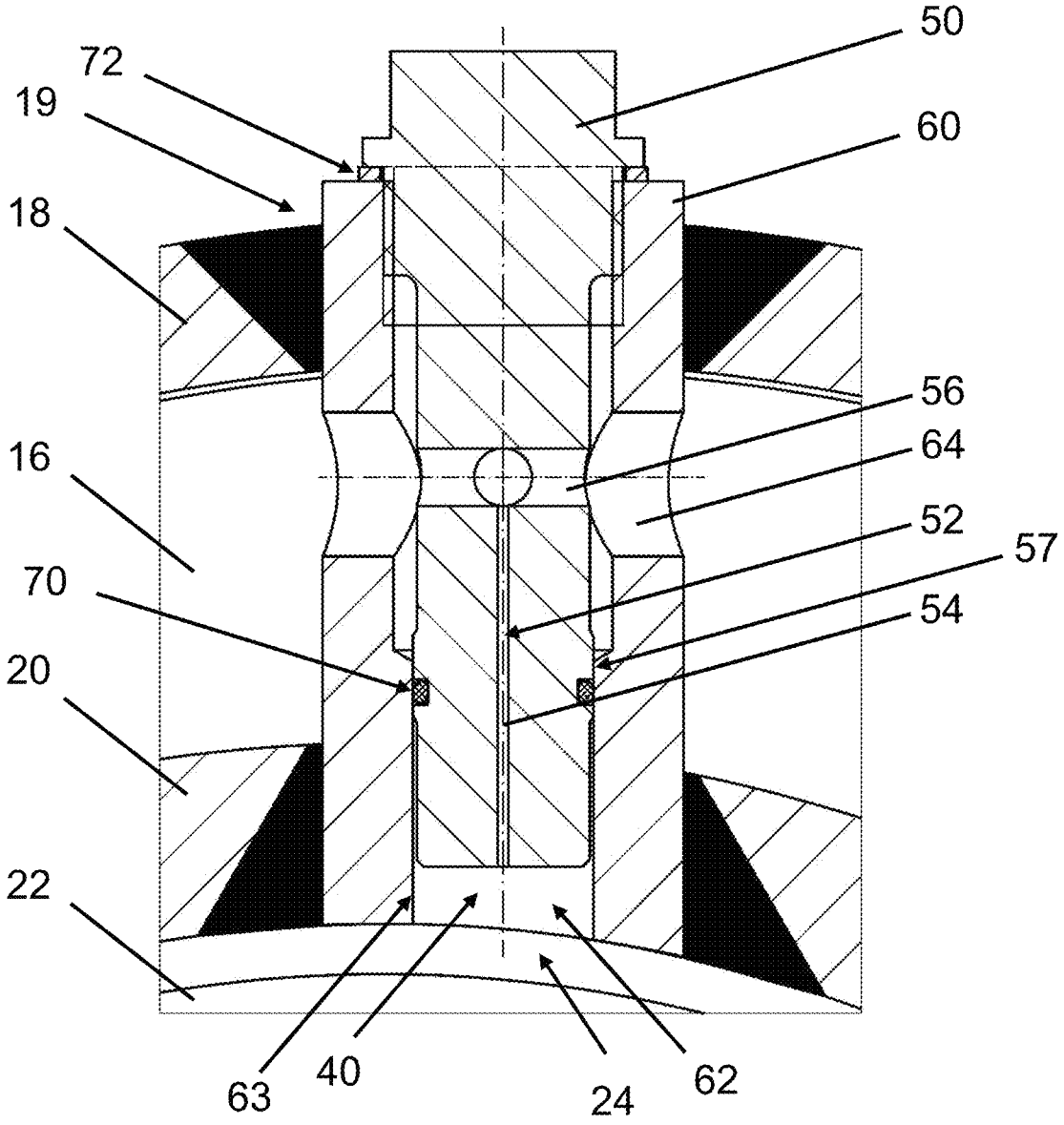
FIG. 3 illustrates a close-up of a cross-section view of the recirculation line of the pump, according to some embodiments.

FIG. 3 shows a detailed perspective of the cross-sectional view from FIG. 2. The socket 60 comprises a longitudinal bore 62 into which the insert 50 is inserted. In the embodiment shown, the insert 50 is configured as a screw-in bolt and comprises a longitudinal bore 54 in the form of a blind bore that is fluidly connected to the longitudinal bore 62 of the socket 60 and forms the predefined, fixed flow area 52. In addition, the insert 50 comprises a transverse bore 56 that is fluidly connected to the longitudinal bore 54 of the insert 50 and a transverse bore 64 of the socket 60. The longitudinal bore 54 of the insert 50 and the longitudinal bore 62 of the socket 60 are arranged substantially coaxially in relation to one another. The transverse bore 56 of the insert 50 and the transverse bore 64 of the socket 60 are also arranged substantially coaxially in relation to one another. Additionally, the transverse bore 64 of the socket 60 has a larger diameter than the transverse bore 56 of the insert 50.

In the example shown, the socket 60 and the insert 50 together form the recirculation line 40. During recirculation, medium from the pressure chamber 24 enters the longitudinal bore 54 of the insert 50 via the longitudinal bore 62 of the socket 60. From there, the medium enters the transverse bore 64 of the socket 60 via the transverse bore 56 of the insert 50 and finally reaches the suction chamber 16.

The socket 60 is configured to correspond to the openings 19, 24. In the example shown, the socket has an outer diameter that substantially corresponds to, for example, an inner diameter of the openings 19, 24. In addition, the insert 50 has an outer diameter 57 that substantially corresponds to an inner diameter 63 of the longitudinal bore 62 of the socket 60. On the outside of the insert 50, a sealing element 70 in the form of an O-ring may be arranged, which prevents or reduces a leakage of medium between the outer diameter 57 of the insert 50 and the inner diameter 63 of the socket 60.

A further sealing element 72 in the form of a sealing washer may be arranged between a head of insert 50 and an upper side of socket 60.

When a different delivery rate of the pump 10 at a predefined speed of the transport elements 30 is desired, the insert 50 can be replaced with a different insert having a different predefined, fixed flow area, with dimensions such that the effective delivery rate of the pump 10 at a predefined speed of the transport elements 30 corresponds to the desired delivery rate at the predefined speed of the transport element 30. Alternatively, the insert 50 can be retooled accordingly to have a predefined, fixed flow area 52 with dimensions such that the effective delivery rate of the pump 10 at a predefined speed of the transport elements 30 corresponds to the desired target delivery rate at the predefined speed of the transport element 30.

Figure 4:
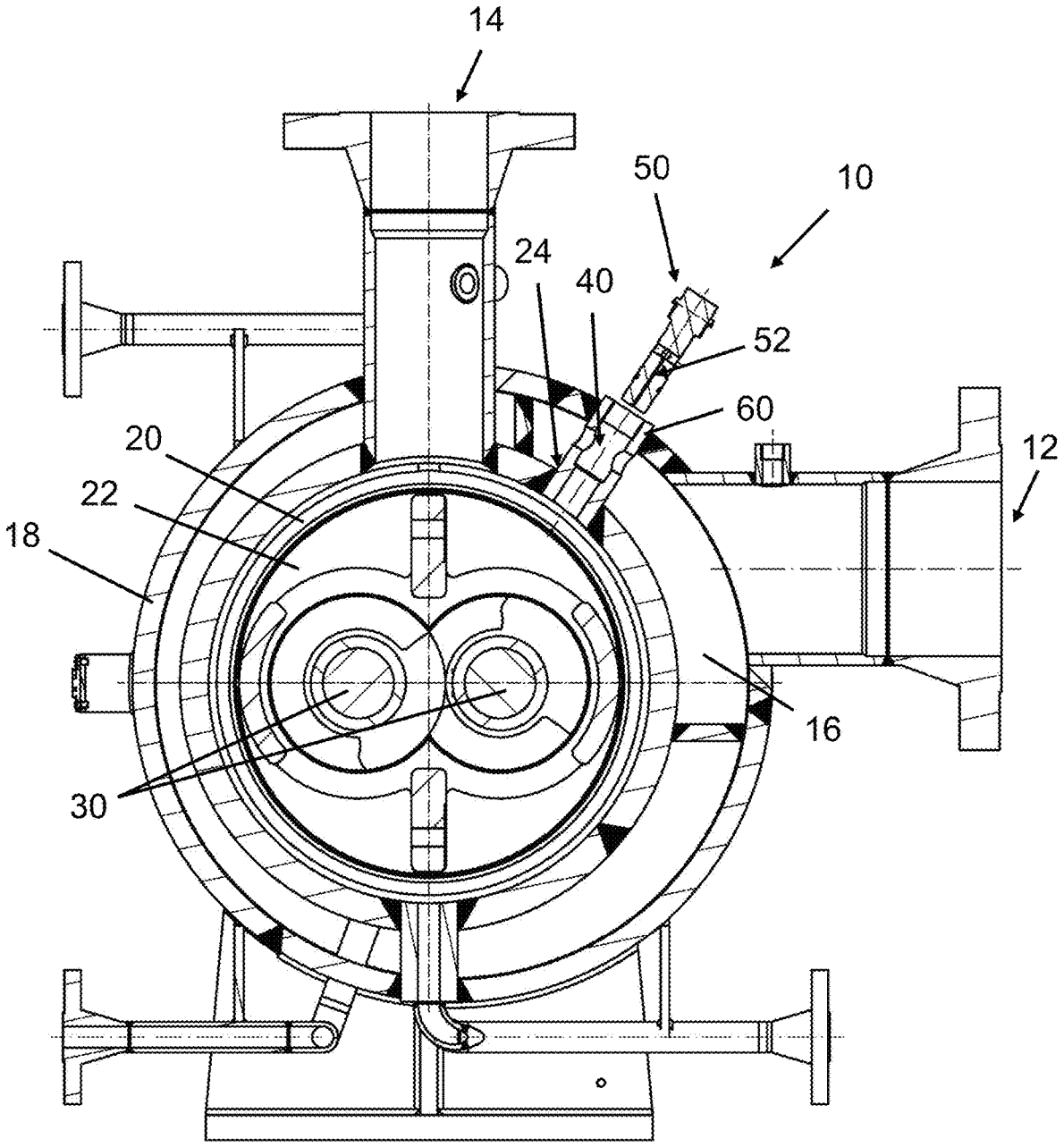
FIG. 4 illustrates a front cross-section view of the pump of FIG. 1, the pump having an insert removed from the socket, according to some embodiments.

FIG. 4 shows a sectional view of the pump 10 in a state in which the insert 50 has been removed from the socket 60. In the removed state, the insert 50 can be retooled, for example by drilling the longitudinal bore 54 to have a larger predefined, fixed flow area 52. The insert 50 can then be reinserted into the socket 60.

Figure 5:
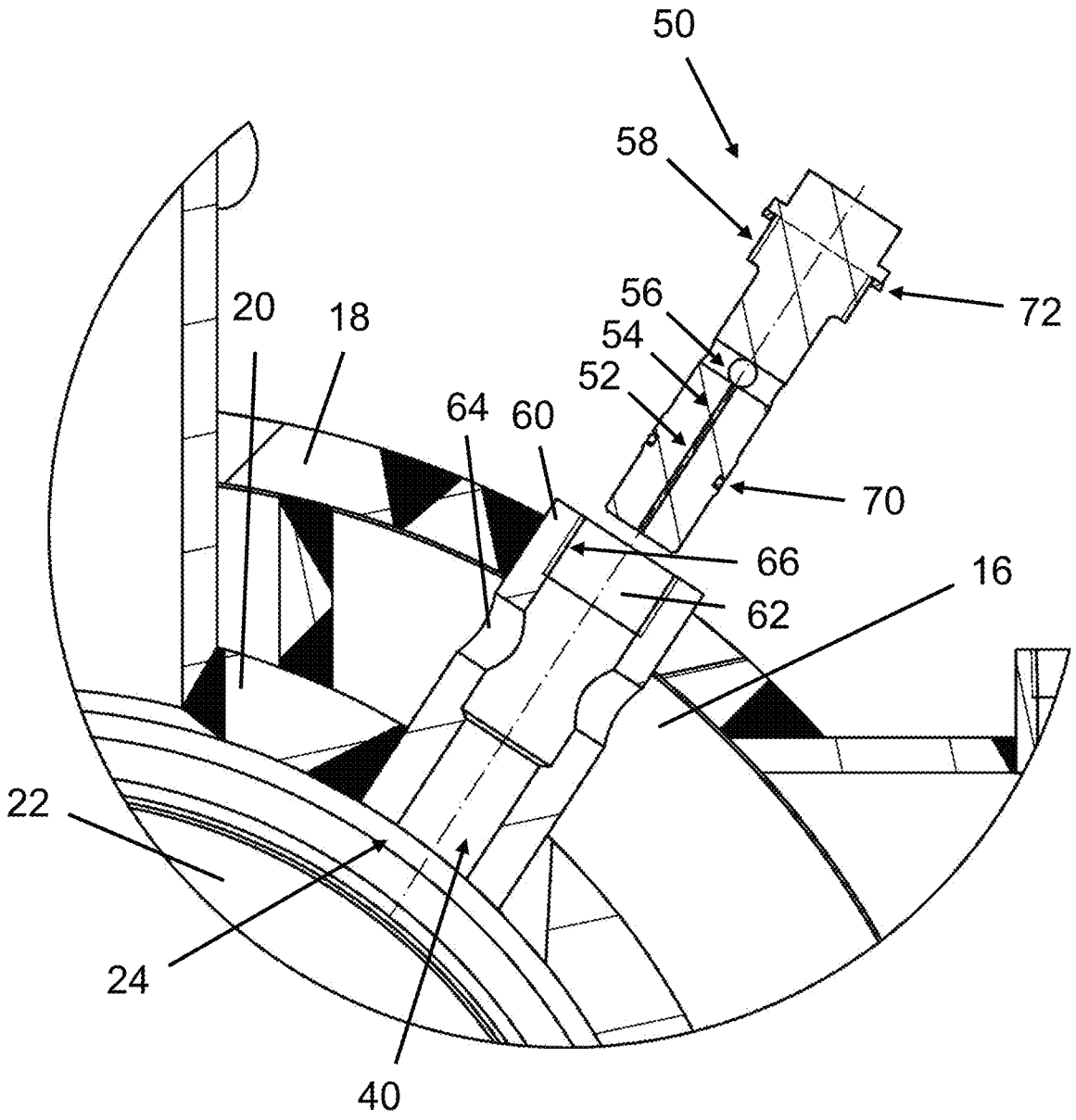
FIG. 5 illustrates a close-up of a cross-section view of the recirculation line of the pump, the pump having the insert removed from the socket, according to some embodiments.

FIG. 5 shows a detailed view of the sectional view from FIG. 4. The insert 50 comprises an outer thread 58 that is configured to correspond to an inner thread 66 of the socket 60.

What is claimed:

1. A pump for conveying a medium comprising:
- a suction-side inlet;
- a pressure-side outlet;
- a suction chamber;
- a conveyance housing comprising a pressure chamber;
- a transport element rotatably supported in the conveyance housing, wherein the transport element is configured to convey a medium from the suction chamber into the pressure chamber;
- a recirculation line configured to supply the medium from the pressure chamber to the suction chamber; and
- an exchangeable insert comprising a fixed flow area positioned in the recirculation line, wherein the exchangeable insert comprises a bolt configured to be screwed in, clamped in, or inserted.

2. The pump of claim 1, wherein the exchangeable insert is positioned in an opening of the conveyance housing or a socket positioned in the opening of the conveyance housing.

3. The pump of claim 2, wherein the socket corresponds to the opening and the insert corresponds to the socket.

4. The pump of claim 2, wherein the socket penetrates the suction chamber.

5. The pump of claim 2, wherein the insert corresponds to the opening.

6. The pump of claim 1, wherein the insert comprises a longitudinal bore and a transverse bore that are fluidly connected to one another, wherein the medium travels from the pressure chamber into the insert via the longitudinal bore and out of the insert into the suction chamber via the transverse bore.

7. The pump of claim 1, wherein the fixed flow area of the insert is the smallest flow area of the recirculation line.

8. The pump of claim 1, wherein the insert comprises a sealing element, wherein the sealing element is an O-ring or a sealing tape.

9. A method for adjusting the delivery rate of a pump for conveying a medium, the method comprising:
- determining the effective delivery rate of a pump at a predefined speed of the transport element;
- determining the deviation of the effective delivery rate of the pump at the predefined speed of a transport element compared to a target delivery rate at the predefined speed of the transport element; and
- inserting an insert having a fixed flow area into a recirculation line, wherein the fixed flow area of the insert has dimensions such that the effective delivery rate of the pump at the predefined speed of the transport element corresponds to the target delivery rate at the predefined speed of the transport element.

10. The method of claim 9, wherein the pump comprises:
- a suction-side inlet;
- a pressure-side outlet;
- a suction chamber;
- a conveyance housing comprising a pressure chamber;
- a transport element rotatably supported in the conveyance housing configured to convey the medium from the suction chamber into the pressure chamber; and
- a recirculation line configured to transport the medium from the pressure chamber to the suction chamber.

11. The method of claim 9, wherein the determination of the effective delivery rate of the pump is carried out at at least one of a defined viscosity of the medium or a defined differential pressure.

12. A pump for conveying a medium comprising:
- a suction-side inlet;
- a pressure-side outlet;
- a suction chamber;
- a conveyance housing comprising a pressure chamber;
- a transport element rotatably supported in the conveyance housing, wherein the transport element is configured to convey a medium from the suction chamber into the pressure chamber;
- a recirculation line configured to supply the medium from the pressure chamber to the suction chamber; and
- an exchangeable insert comprising:
  - a fixed flow area positioned in the recirculation line; and
  - a longitudinal bore and a transverse bore that are fluidly connected to one another, wherein the medium travels from the pressure chamber into the exchangeable insert via the longitudinal bore and out of the insert into the suction chamber via the transverse bore.

* * * * *